US010443246B2

(12) United States Patent
Costello

(10) Patent No.: US 10,443,246 B2
(45) Date of Patent: Oct. 15, 2019

(54) STAIR EDGING COMPONENT

(71) Applicant: ANY STEP TECHNOLOGY LIMITED, Auckland (NZ)

(72) Inventor: Anthony William Costello, Kerikeri (NZ)

(73) Assignee: Patent Agencies Limited, Auckland (NZ)

( * ) Notice: Subject to any disclaimer, the term of this patent is extended or adjusted under 35 U.S.C. 154(b) by 509 days.

(21) Appl. No.: 14/904,476

(22) PCT Filed: Jul. 11, 2014

(86) PCT No.: PCT/NZ2014/000142
§ 371 (c)(1),
(2) Date: Jan. 12, 2016

(87) PCT Pub. No.: WO2015/005805
PCT Pub. Date: Jan. 15, 2015

(65) Prior Publication Data

US 2016/0215502 A1 Jul. 28, 2016

(30) Foreign Application Priority Data

Jul. 12, 2013 (NZ) ..... 613159

(51) Int. Cl.
*E04F 11/16* (2006.01)
*B28B 1/14* (2006.01)
(Continued)

(52) U.S. Cl.
CPC ..... *E04F 11/166* (2013.01); *B28B 1/14* (2013.01); *B28B 7/18* (2013.01); *B28B 7/225* (2013.01);
(Continued)

(58) Field of Classification Search
CPC ..... E04F 11/163; E04F 11/166; E04F 11/17; E04F 11/175; E04F 11/09; E04F 11/104;
(Continued)

(56) References Cited

U.S. PATENT DOCUMENTS 597,966 A * 1/1898 Emery ..... E06C 7/083 182/228.3
848,075 A * 3/1907 Wainwright ..... E04F 11/163 404/19
(Continued)

FOREIGN PATENT DOCUMENTS

| | | |
|---|---|---|
| EP | 0224918 | 11/1991 |
| EP | 0224918 B1 | 11/1991 |
| FR | 1220512 | 5/1960 |

OTHER PUBLICATIONS

International Search Report, PCT Application No. PCT/NZ2014/000412, dated Dec. 3, 2014, 3 pgs.
(Continued)

*Primary Examiner* — Kyle J. Walraed-Sullivan
(74) *Attorney, Agent, or Firm* — Sandberg Phoenix & von Gontard, P.C.

(57) ABSTRACT

The present invention provides a stair edging component or nosing assembly comprising a plurality of elongate inserts, each insert comprising a main body portion having a tread surface and a coupling interface to couple the insert to the stair, and an opening extending through the length thereof, a locating spacer located between each pair of inserts, and a tensioning means extending through the opening in each insert and along the length of the stair edging component.

12 Claims, 11 Drawing Sheets

(51) Int. Cl.

| | |
|---|---|
| ***B28B 7/18*** | (2006.01) |
| ***B28B 7/22*** | (2006.01) |
| ***B28B 23/00*** | (2006.01) |
| ***E04G 21/18*** | (2006.01) |
| ***E04F 15/02*** | (2006.01) |
| *E04F 11/02* | (2006.01) |

(52) U.S. Cl.
CPC ..... *B28B 23/0056* (2013.01); *E04F 11/163* (2013.01); *E04F 15/02172* (2013.01); *E04G 21/185* (2013.01); *E04F 2011/0212* (2013.01)

(58) Field of Classification Search
CPC ..... E04F 11/116; E04F 14/02172; E04F 14/02161; E04F 2011/0212; E04G 21/185; Y10T 428/22; A47B 2077/027; A47B 77/022; A47B 96/18
USPC ..... 52/179, 181, 180; 294/14
See application file for complete search history.

(56) References Cited

U.S. PATENT DOCUMENTS 851,531 A * 4/1907 Lea ..... E04F 11/025 249/14
875,113 A * 12/1907 Schachner ..... E04F 11/022 249/14
1,344,310 A * 6/1920 Parker ..... E04F 11/17 52/179
1,377,960 A * 5/1921 Dodge ..... C04B 33/13 106/36
1,681,073 A * 8/1928 Welcome ..... E04F 11/166 280/169
1,716,224 A * 6/1929 Friderichsen ..... E04F 11/163 404/68
1,799,405 A * 4/1931 Bois ..... E04F 11/025 249/14
1,936,224 A * 11/1933 Awbrey ..... E04F 11/163 52/179
2,113,462 A * 4/1938 De Wees ..... E04F 11/16 52/179
2,537,396 A * 1/1951 Cato ..... B28B 7/225 249/14
2,835,937 A * 5/1958 Hobbs ..... E04F 11/166 52/179
3,287,867 A * 11/1966 Aton ..... E04F 11/163 52/179
3,334,456 A * 8/1967 Naka ..... E04F 11/166 428/67
3,381,775 A * 5/1968 Livers ..... E04F 11/025 182/106
3,421,274 A * 1/1969 Reiff ..... E04F 11/166 52/179
4,001,991 A * 1/1977 Balzer ..... E04F 11/166 52/179
4,058,942 A * 11/1977 Naka ..... E04F 11/163 428/124
4,060,947 A * 12/1977 Naka ..... E04F 11/163 428/124
4,318,951 A * 3/1982 Naka ..... E04F 11/16 428/167
4,321,293 A * 3/1982 Naka ..... E04F 11/166 428/167
4,321,294 A * 3/1982 Naka ..... A47G 27/06 428/100
4,455,797 A * 6/1984 Naka ..... E04F 11/163 52/179
4,625,266 A * 11/1986 Winter ..... F21V 33/006 362/145
4,858,404 A * 8/1989 Schluter ..... E04F 11/163 52/179
5,026,018 A * 6/1991 Ayala ..... E04G 13/062 249/14
5,051,289 A * 9/1991 Riddle ..... E04F 11/163 428/162
5,253,932 A * 10/1993 Nesovic ..... A47B 96/18 108/27
5,706,623 A * 1/1998 Brown ..... A47G 27/0287 52/179
5,806,253 A * 9/1998 Nelson ..... E04F 11/166 52/179
5,918,962 A * 7/1999 Nagano ..... F21V 15/013 362/146
6,029,408 A * 2/2000 Cavaness ..... E04F 11/025 52/182
6,076,936 A * 6/2000 George ..... F21S 8/032 362/146
6,115,975 A * 9/2000 Abdollahi ..... E04F 11/163 52/179
6,258,190 B1 * 7/2001 Sciarrino ..... A47B 77/022 108/27
6,606,827 B1 * 8/2003 Hoffmann ..... G09F 13/22 362/146
D570,037 S * 5/2008 Hartman ..... D26/138
8,419,205 B1 * 4/2013 Schmuckle ..... F21V 33/006 362/145
2005/0251955 A1 * 11/2005 Roychowdhury ... A47G 27/065 16/10
2006/0179791 A1 * 8/2006 Shaw ..... E04F 11/116 52/749.13
2007/0028534 A1 * 2/2007 Defehr ..... B44C 5/043 52/179
2008/0295422 A1 * 12/2008 Neuhofer, Jr. ..... E04F 11/166 52/179
2009/0235594 A1 * 9/2009 Won ..... E04F 11/02 52/179
2009/0266969 A1 10/2009 Costello et al.
2010/0146879 A1 * 6/2010 Chin ..... E04F 11/1045 52/177
2011/0179729 A1 * 7/2011 Thompson ..... E04F 11/104 52/179
2011/0283636 A1 * 11/2011 Vanhastel ..... E04F 11/175 52/179
2012/0204502 A1 * 8/2012 Gardner ..... E04F 11/166 52/179
2012/0297705 A1 * 11/2012 Kay ..... E04F 11/166 52/179
2014/0013681 A1 * 1/2014 Disch ..... E04F 11/16 52/179
2014/0318047 A1 * 10/2014 Mensah ..... E04F 11/17 52/179
2015/0361670 A1 * 12/2015 Sgambelluri ..... E04F 11/108 52/179
2016/0215502 A1 * 7/2016 Costello ..... E04F 11/163
2016/0376793 A1 * 12/2016 Halischuk ..... E04F 11/166 52/179
2017/0328069 A1 * 11/2017 Schumacher ..... E04F 11/1042

OTHER PUBLICATIONS

Written Opinion, PCT Application No. PCT/NZ2014/000412, dated Dec. 3, 2014, 5 pgs.
International Search Report, PCT Application No. PCT/NZ20014/000412, dated Dec. 3, 2014 3 pgs.
Written Opinion, PCT Application No. PCT/NZ2014/000412, dated Dec. 3, 2014, 3 pgs.

* cited by examiner

C
23
25a 15
26
29
25b 30
25c
24
B

24

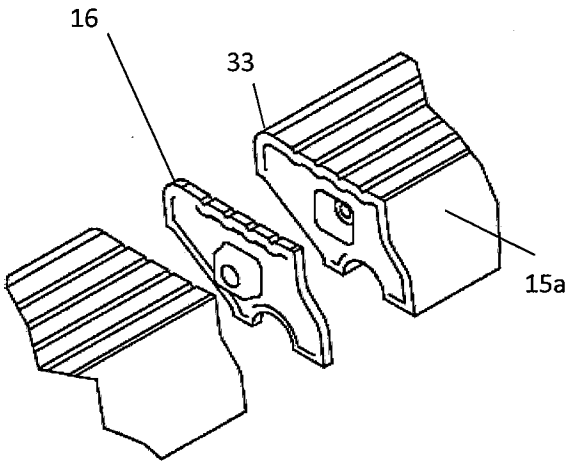
Figure 16
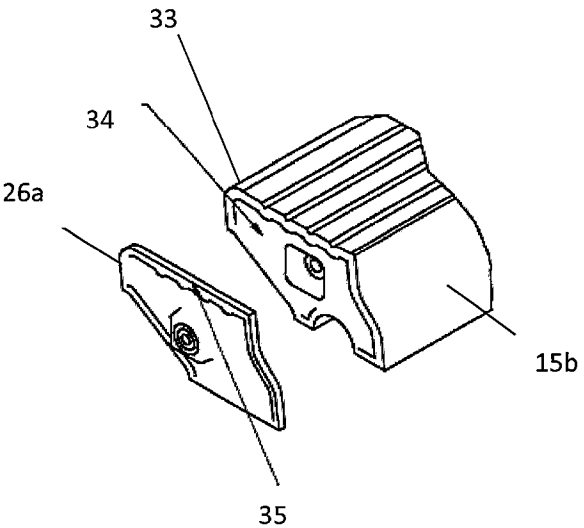

STAIR EDGING COMPONENT

This application is a U.S. National Stage Application under 35 U.S.C. § 371 of International Application No. PCT/NZ2014/000142, filed Jul. 11, 2014, which claims priority to New Zealand Application No. 61359 filed Jul. 12, 2013. Each of the above-referenced applications is expressly incorporated by reference herein its entirety.

FIELD OF THE INVENTION

The present invention relates to a stair edging component. In particular, this invention relates to a stair edging component useful in the constructions of stairs and to a method of producing such a stair edging component.

BACKGROUND

Each step in the flight of stairs comprises a horizontal tread and vertical riser. The meeting edge of the tread and riser is often termed the nosing. This edge or nosing may be prone to forces that can cause damage to it.

There is also a regulatory requirement in some jurisdictions to provide stairs with high visibility and anti-slip edges. This is to improve the safe use of the stairs, particularly for disabled or sight impaired users.

To address these issues, a stair may be provided with a nosing extrusion or insert, which can provide a stronger edge to the stair. The nosing extrusion may be provided with a high visibility area or portion and/or an anti-slip area or portion, which may reduce damage and improve the safety of users.

Some staircases are moulded from a settable material such as concrete. An example of this type of staircase is found in U.S. Pat. No. 8,262,055, which describes a method of forming concrete flights of stairs. This method is used in the erection of many types of buildings, particularly commercial and industrial buildings.

For this type of staircase, edging or nosing extrusions are usually affixed to the staircase after moulding. Affixing such extrusions to the edge of each stair after moulding can be labour intensive and expensive.

A need has been identified for a stair edging component or nosing extrusions that is made as a separate item and then used in concrete stair moulding systems such as those described in U.S. Pat. No. 8,262,055 to create a pre-cast concrete stair with a high visibility and anti-slip edge on the leading edge of each step of the stair.

It is therefore an object of the present invention to provide an improvement on existing stair edging components and systems or to at least provide a useful alternative to known components and systems.

SUMMARY OF THE INVENTION

In a first aspect, the present invention provides an elongate insert for a leading edge of a stair, the insert comprising:

a main body having a tread surface and a coupling interface to couple the insert to the stair, and an opening extending through the length thereof.

Preferably, the insert further comprises a locating recess at at least one end thereof, more preferably at each end thereof.

Preferably, the coupling interface comprises at least one hooking part for securing the insert to the stair.

Preferably, the coupling interface comprises at least one recess for engagement with a lip of the stair.

Preferably, the coupling interface comprises at least one clamping recess adapted to receive a positioning device during moulding of the stair.

Preferably, the insert is formed substantially of concrete, with a pipe extending therethrough to define the opening.

Preferably, the tread surface of the insert is at least slightly concave.

In a second aspect, the present invention provides a stair edging component or nosing assembly comprising:

a plurality of elongate inserts, each insert comprising a main body having a tread surface and a coupling interface to couple the insert to the stair, and an opening extending through the length thereof, a locating spacer located between each pair of inserts, and a tensioning means extending through the opening in each insert and along the length of the stair edging component.

Preferably, each locating spacer is provided with an opening therein, corresponding to the opening in each insert.

Preferably, the profile of each insert is substantially similar to the profile of each locating spacer.

Preferably, at least one surface of each locating spacer is at least slightly concave.

Preferably, the tread surface of each insert is at least slightly concave.

Preferably, the tensioning means is a wire or cable.

Preferably, the tensioning means is secured by way of one or more crimping ferrules.

Preferably, the stair edging component or nosing assembly further comprises a locating spacer at each end thereof.

Preferably, each insert is further provided with one or more locating pins.

In a third aspect, the present invention provides a mould assembly for forming an insert for a leading edge of a stair, the mould assembly comprising:

first and second mould extrusions shaped to provide a tread surface and a coupling interface to an insert moulded therein, and one or more spacer locating formers located within the first or second mould extrusion and adapted to locate sections of pipe within the mould extrusions.

Preferably, the mould assembly is shaped to provide the tread surface of the insert with a slightly concave surface.

In a fourth aspect, the present invention provides a method of forming a stair edging component or nosing assembly, the method comprising:

providing a plurality, of inserts, each insert comprising a main body portion having a tread surface and a coupling interface to couple the insert to the stair, and an opening extending through the length thereof, providing a locating spacer between each pair of inserts, each locating spacer being provided with an opening, extending a tensioning means through the opening in each insert and in each locating spacer, tensioning the tensioning means until the plurality of inserts and the locating spacers are held firmly together.

Preferably, tensioning of the tensioning means is achieved using a tensioning jig.

Preferably, the tensioning means is held in place after tensioning by means of one or more crimping ferrules.

This brief summary of the invention broadly describes the features and advantages of certain embodiments of the invention. Further features and advantages will be described in the detailed description of the invention that follows.

Novel features that are believed to be characteristic of the invention will be better understood from this detailed description when considered in connection with the accompanying drawings. However, the accompanying drawings are intended to help illustrate the invention or assist with understanding the invention, and are not intended to define the scope of the invention.

BRIEF DESCRIPTION OF THE DRAWINGS

The invention will now be described by way of example only and with reference to the following drawings, in which:

FIG. 15: shows an expanded view of portion D from FIG. 14.

FIG. 16: shows a perspective view of a stair edging component or insert according to a further aspect of the present invention.

DETAILED DESCRIPTION OF THE INVENTION

The present invention relates to a stair edging component or nosing extrusion that is made as a separate item and then used in concrete stair moulding system such as that described in U.S. Pat. No. 8,262,055. The nosing extrusion of the present invention may be used to create a pre-cast concrete stair with high visibility and anti-slip leading edge on each stair. This leading edge may also be durable and hard-wearing.

Figure 2:
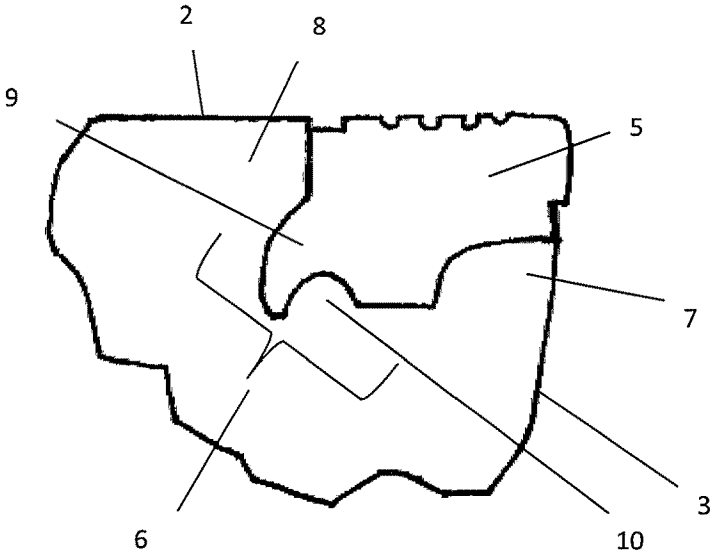
FIG. 2: shows a side view of one of the stair edging components shown in FIG. 1.
Figure 1:
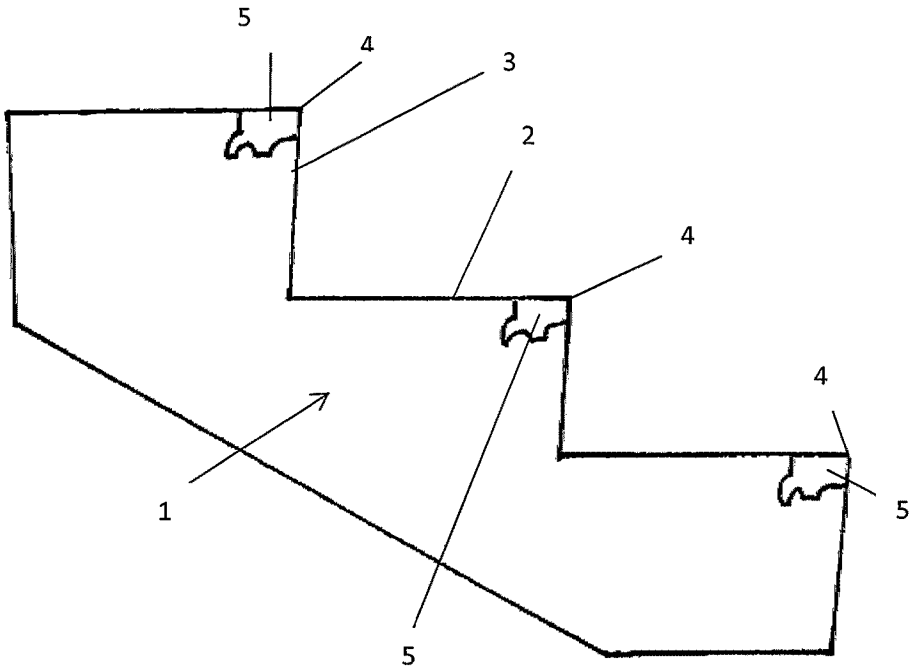
FIG. 1: shows a side view of a flight of stairs showing stair edging components according to one aspect of the present invention.

The stair edging component or nosing extrusion of the present invention is shown in FIGS. 1 and 2 of the accompanying drawings. FIG. 1 shows a section of a flight of stairs 1. The stair 1 comprises steps, each having a tread surface 2 and a riser surface 3. Each step has a leading edge or nosing 4. The leading edge or nosing 4 may be formed by placing a nosing extrusion 5 into a stair mould and moulding it into a step of the stair 1.

One embodiment of the nosing extrusion 5 is shown in more detail in FIG. 2. The cross-sectional shape of the nosing extrusion 5 is generally designed to ensure that when moulded into a stair it is held firm and cannot be easily dislodged. This may be achieved by providing the nosing extrusion 5 with a coupling interface 6, which creates a profile for securing the nosing extrusion 5 to the stair.

The coupling interface 6 includes a recess 7 formed in the riser surface 3. When moulded into a stair, the material making up the stair, preferably concrete, flows into this recess 7. The recess 7 has enough volume to ensure that the step beneath the component is sufficiently strong.

Additionally, the nosing extrusion 5 preferably has a rear recess 8 causing the formation of a protrusion 9 at the back of the nosing extrusion 5. The protrusion 9 will have enough distance from the nosing extrusion's edge on the tread surface 2 to stop any upward movement during the casting of the nosing extrusion 5 in a stair.

Figure 4:
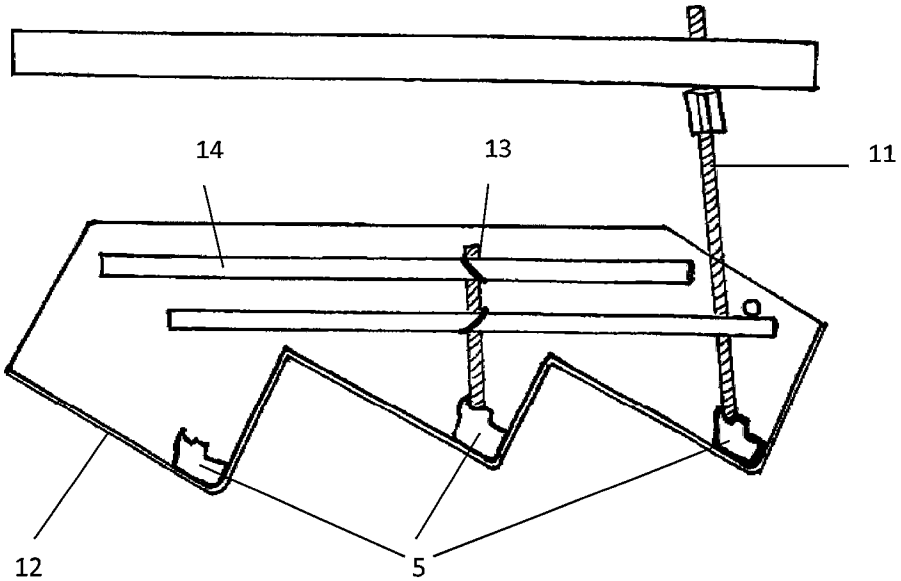
FIG. 4: shows a side view of an apparatus for moulding a stair edging component of the present invention into a stair.

A clamping or recess or groove 10 may also be provided. This receives a positioning device (shown in FIG. 4) during moulding of a stair, and is used for placement and holding of the nosing extrusion 5 during the stair moulding process.

Figure 3:
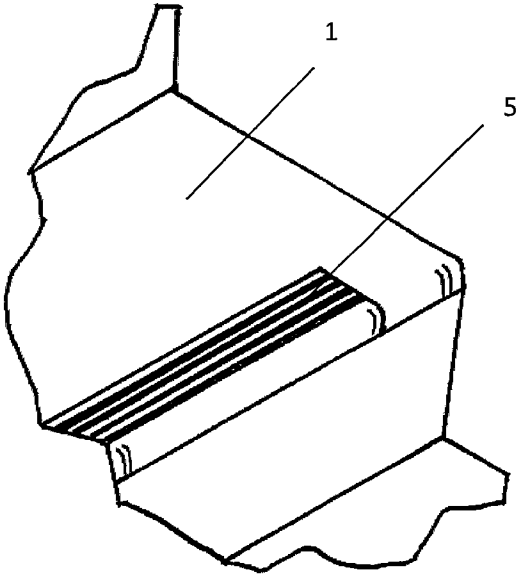
FIG. 3: shows a partial perspective view of a flight of stairs showing a stair edging component.

A nosing extrusion 5 moulded into a stair 1 is shown in FIG. 3. The nosing extrusion 5 is preferably moulded in place at each step edge during the moulding of a stair or staircase, in the manner generally illustrated in FIG. 4. A plurality of clamping rods 11 are used to hold each of the nosing extrusions 5 in a correct place in the stair mould 12, or alternatively a short length of a threaded rod (becoming the clamping rods) 13 is fixed on to reinforcing members 14 and then screw downward pressure on to the nosing extrusion 5. The stair or staircase may then by formed, as described in U.S. Pat. No. 8,262,055.

Figure 5:
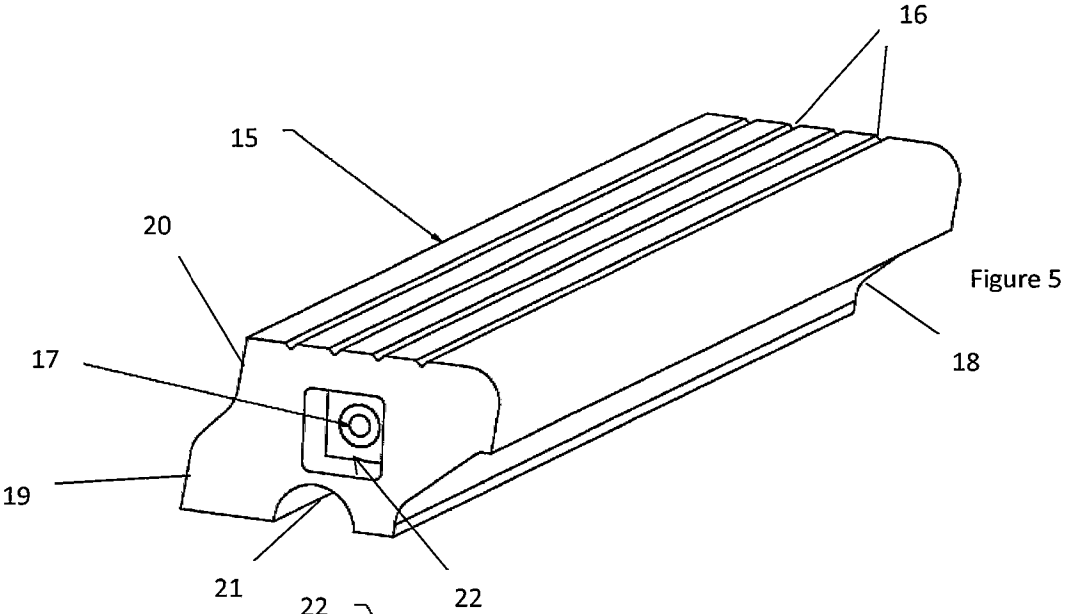
FIG. 5: shows a perspective view of a stair edging insert according to one aspect of the present invention.
Figure 7:
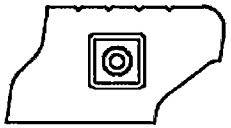
FIG. 7: shows an end view of an insert according of an alternative aspect of the present invention.

The nosing assembly 5 of the present invention comprises a plurality of inserts 15 as shown in FIG. 5.

Preferably, each insert 15 comprises a main body portion with a tread surface provided with a plurality of grooves 16 (or some other suitable feature to provide a gripping or non-slip surface).

The insert 15 may be of any convenient length, for example, 335 mm, 300 mm, 280 mm, 125 mm or even 75 mm.

Each insert 15 is provided with an opening 17 extending therethrough. Each opening 17 is adapted to accept a tensioning wire or rod, as described in more detail below. The opening 17 may be formed by providing a PVC pipe or other suitable tubing, moulded into the insert 15, as also described in more detail below.

Figure 6:
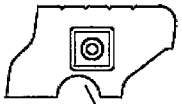
FIG. 6: shows an end view of the insert shown in FIG. 5.

Each insert 15 is provided with a recess 18 of a suitable shape to assist the insert 15 to be retained in a stair. In the embodiment shown in FIGS. 5 and 6, the insert 15 is also provided with protrusion 19 and recess 20 for this purpose, along with additional recess 21. This recess 21 assists in clamping the insert 15 into the stair forming mould, in a manner similar to that shown in FIG. 4.

Figure 8:
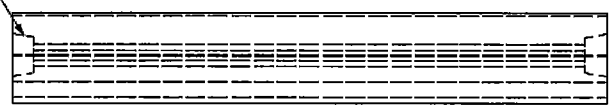
FIG. 8: shows a cross-sectional plan view of the insert shown in FIG. 5.

As shown in FIG. 8, each end of the insert 15 may also be provided with locating recesses 22, each adapted to house at least a portion of a locating spacer, as described below. Preferably, each locating recess 22 may be tapered slightly, to assist with adequate location of the locating spacers.

Figures 9, 10:
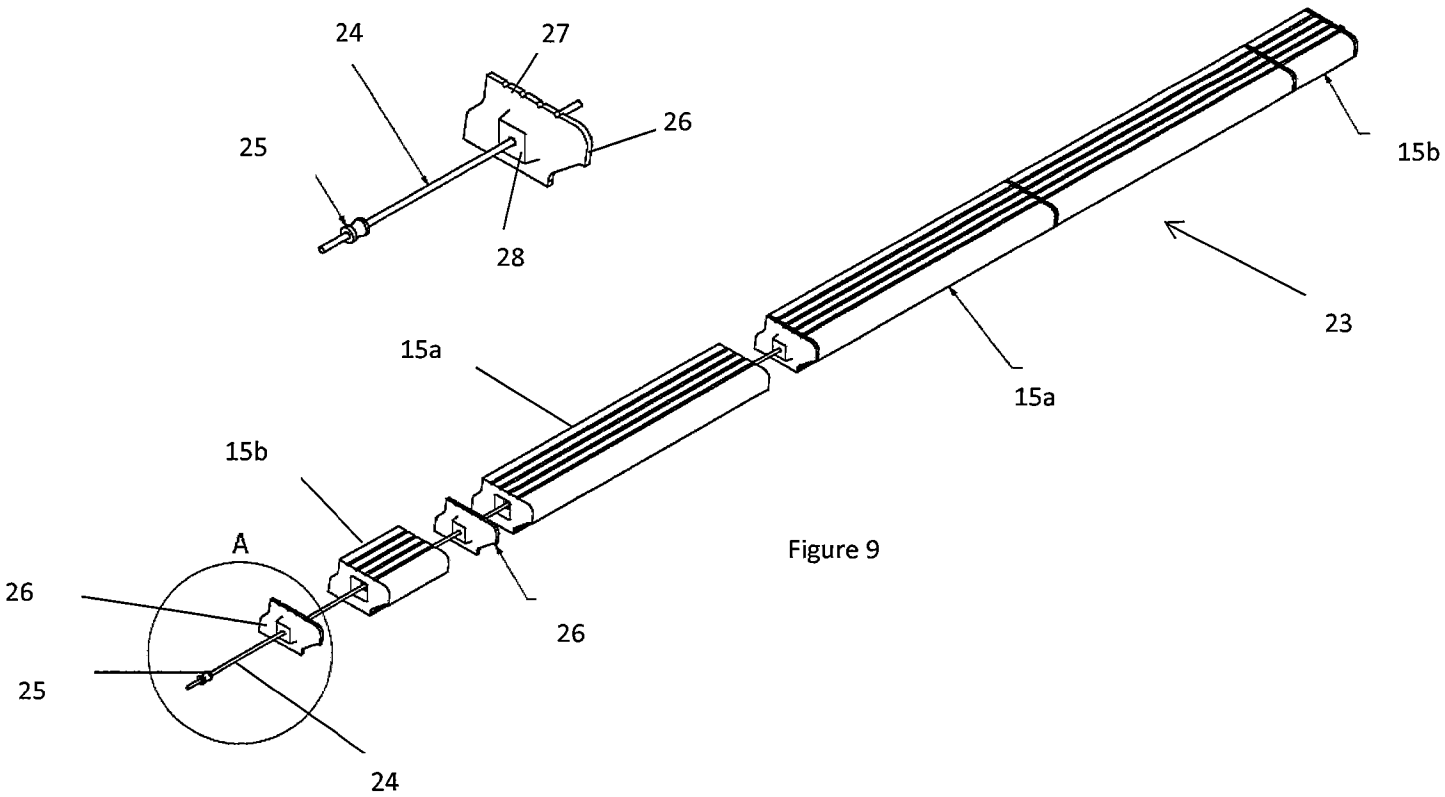
FIG. 9: shows a perspective view of the stair edging component or nosing extrusion according one aspect of the present invention.
FIG. 10: shows an expanded view of portion A from FIG. 9.

A nosing assembly 23 of the present invention is shown in FIG. 9. The nosing assembly 23 comprises a plurality of inserts 15*a* and 15*b*. The longer insert sections 15*a* are usually central sections, located between shorter peripheral insert sections 15*b*.

The openings 17 of each insert 15*a*, 15*b* are adapted to accept a tensioning wire or rod 24 (hereafter wire 24). In one preferred embodiment, the wire 24 may be a 316 stainless steel cable of about 2.5 mm thickness. The use of 316 stainless steel cable will eliminate corrosion.

At least one end of the wire 24 is provided with a securing means, such as at least one crimping ferrule 25. The crimping ferrule 25 may preferably be formed of stainless steel.

As well as the inserts 15*a*, 15*b*, the nosing assembly 23 may be provided with one or more locating spacers 26. Preferably, a locating spacer 26 is provided between each pair of adjacent inserts 15*a*, 15*b* and also at each end of the nosing assembly 23.

The locating spacer 26 is shown in more detail in FIG. 10. The locating spacer 26 may comprise a main body 27 with a protrusion 28 extending from one side thereof. A hole extends through the main body 27, to accommodate the wire 24. The profile of the locating spacer 26 is preferably substantially similar to the profile of the inserts 15.

Figures 11, 12, 13:
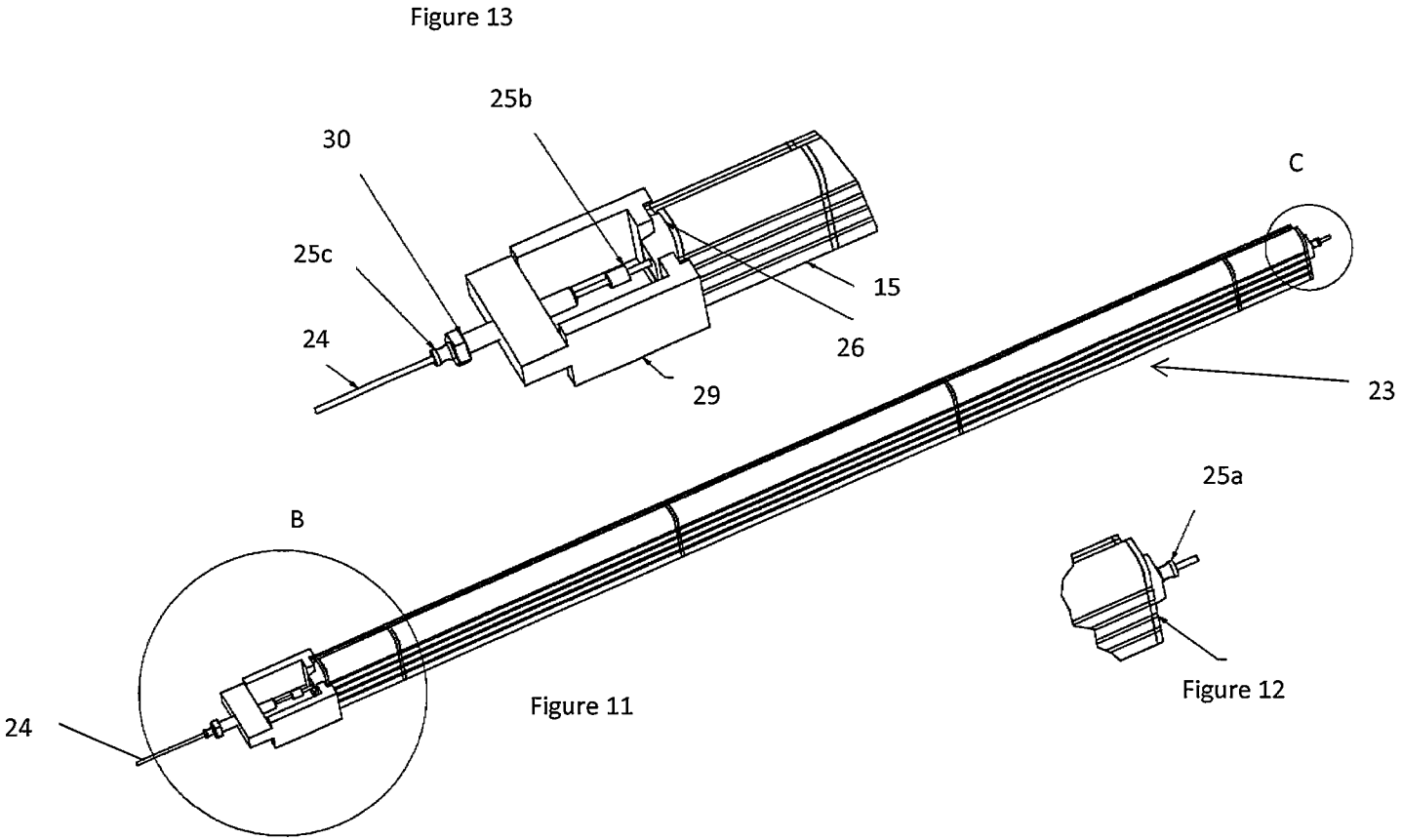
FIG. 11: shows a perspective view of a stair edging component or nosing extrusion according to an alternative aspect of the present invention.
FIG. 12: shows an expanded view of portion C from FIG. 11.
FIG. 13: shows an expanded view of portion B from FIG. 11.

During assembly, a plurality of inserts 15 may be selected, and joined together by way of the locating spacers 26 and wire 24, to produce a stair nosing component or nosing extrusion 23 as shown in FIG. 11. As the inserts 15 may be of any desired length, a suitable number may be selected, in order to form a stair nosing component or nosing extrusion 23 of the desired length.

One advantage of the present invention is that the inserts 15 may be made of any desired length, allowing formation of a stair nosing component or nosing extrusion 23 of any desired length. In addition, individual inserts 15 are shorter than the length of a stair nosing component or nosing extrusion 23, making transport easier and reducing damage that might occur during transportation and use of longer lengths of nosing.

Assembly of the nosing assembly 23 is now described with reference to FIGS. 11 to 13. To assemble the nosing assembly 23, the wire 24 is drawn through a desired number of inserts 15 and locating spacers 26. A first crimping ferrule 25*a*, located at one end, is then crimped on, as shown in FIG. 12.

At an opposite end, a second crimping ferrule 25*b* is located on to the wire 24. A tensioning jig 29 is then placed on the wire 24 and is used to tension up the wire 24. This may be done by drawing an end of the wire 24 through a hole in a bolt 30 of the tensioning jig 29, and screwing the bolt 30 inwardly towards the end of the insert 15, as shown in FIG. 13. A third crimping ferrule 25*c* is then located on the wire 24.

The wire 24 may be pulled tight by hand and then the third, outer crimping ferrule 25*c* is crimped on to the wire 24. The bolt 30 may then be wound outwardly away from the end of the outer insert 15, to tension the wire 24 and thereby draw the inserts 15 firmly together. Once the wire 24 has sufficient tension, the second, inner crimping ferrule 25*b* may be positioned up against the end of the outer insert 15 and may be crimped on to the wire 24.

The wire 24 may then be cut and the tensioning jig 29 removed, resulting in the assembled nosing 23.

Figure 14:
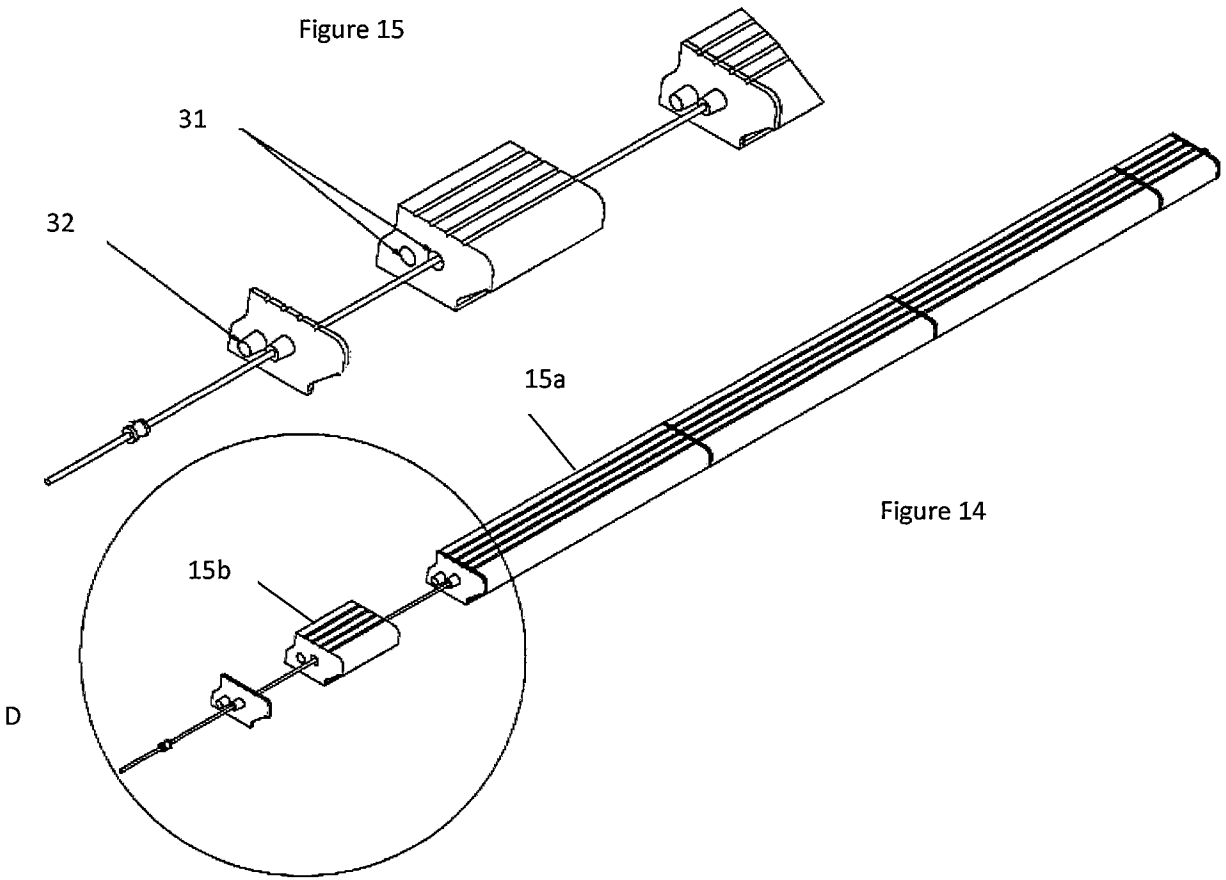
FIG. 14: shows a perspective view of a stair edging component or nosing extrusion according to a still further aspect of the present invention.

An alternative tensioning system is shown in FIGS. 14 and 15. In this aspect of the invention, the inserts 15*a*, 15*b* are additionally provided with locating holes 31 and locating pins 32, which engage upon tensioning of the inserts 15*a*, 15*b*. This arrangement may in some circumstances provide more stability to the nosing assembly 23, for example by preventing twisting of the inserts 15*a*, 15*b* relative to one another.

An alternative insert section is shown in FIG. 16. In this embodiment of the invention, the inserts 15*a*, 15*b* and/or the locating spacers 26 may be provided with bevelled edges, as indicated at 33. These bevelled edges help to minimise chipping of the inserts 15*a*, 15*b*, which may occur for inserts formed of material such as concrete.

The insert 15*a*, 15*b* may also be provided with a recess 34 at each end. This helps to ensure there are no gaps between adjacent insert sections 15*a*, 15*b* and locating spacers 26, to provide a smooth finish to the insert 15.

Each end locating spacer 26*a* as shown in FIG. 16 may preferably be provided with a flat outer surface 35 and the end locating spacers 24*a* preferably have no grooves on the top surface. These features help to minimise concrete ingress when the insert 15 is placing in the stair mould 12.

In addition, the locating spacers 26 used in between adjacent inserts 15*a*, 15*b* may be provided with grooves 16, which in use align with the grooves 16 in the inserts 15*a*, 15*b*.

Figure 17:
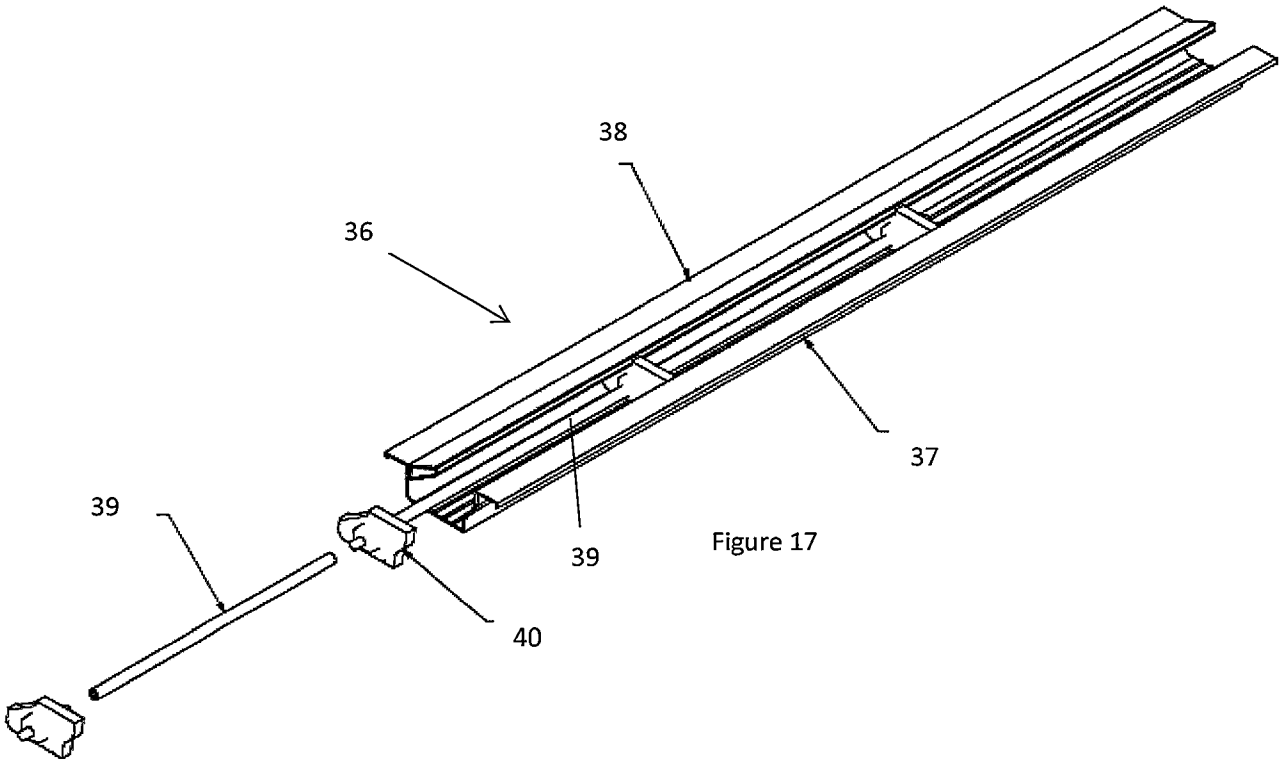
FIG. 17: shows a perspective view of a mould assembly used in the production of a stair edging component or insert of the present invention.
Figure 18:
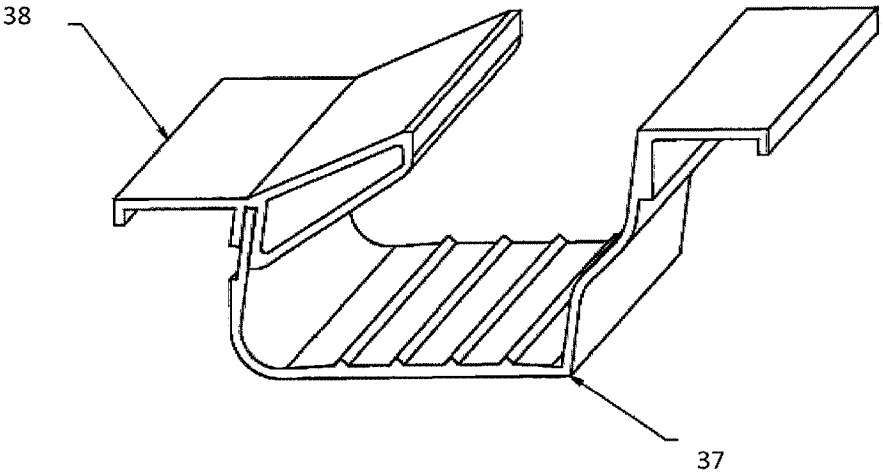
FIG. 18: shows an end view of a short portion of the mould assembly show in FIG. 17.

Referring now to FIGS. 17 and 18, an insert 15*a*, 15*b* of the present invention may be formed using a suitable mould assembly 36. As can be seen from FIG. 18, the mould assembly 36 comprises two parts, a lower mould extrusion 37 and an upper mould extrusion 38. Preferably, these extrusions may be formed of PVC.

The mould assembly 36 may be of any desired length, for example from about 2.5 m to 6 m.

Figure 19:
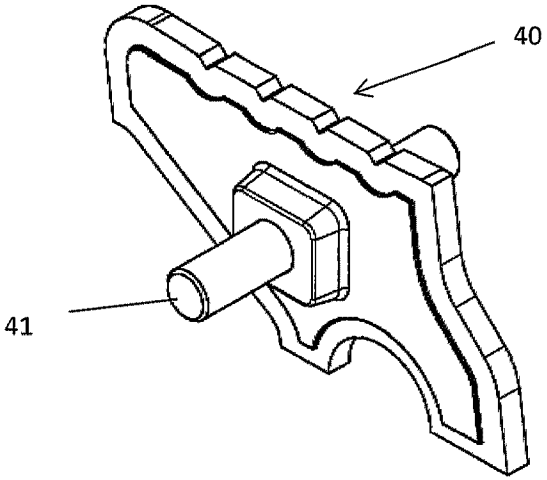
FIG. 19: shows a perspective view of a spacer locating former according to one aspect of the present invention.

To form a plurality of inserts 15*a*, 15*b*, pieces of pipe 39 are located within the mould assembly 36 and are spaced apart and secured in place with spacer locating formers 40. The spacer locating former 40 is shown in more detail in FIG. 19. As will be seen, the spacer locating former 40 is similar in shape and dimension to the locating spacer 26, but is provided with protrusions 41 for housing ends of the pipes 39.

Once the moulding assembly 36 is assembled as shown in FIG. 17, settable material, such as concrete, is poured into the mould and left to harden or set. In a preferred form of the invention, the mould assembly 36 may be provided with a clamping means (not shown) to clamp the lower mould extrusion 37 and the upper mould extrusion 38 together, while the settable material is setting or hardening.

Once the settable material has set or hardened sufficiently, the inserts 15*a*, 15*b* may be removed from the mould assembly 36. To do this, the upper mould extrusion 38 is removed from the mould assembly 36, leaving the inserts 15*a*, 15*b* located in the lower mould extrusion 37. The inserts 15*a*, 15*b* can then be easily removed from the lower mould extrusion 37, for example by tipping this portion of the mould assembly upside down or by simply lifting each insert 15*a*, 15*b* from the lower mould extrusion 37.

The spacer locating formers 40 may be removed, leaving inserts 15 such as that shown in FIG. 5. It will be appreciated that a piece of pipe 39 is cast permanently into the insert 15*a*, 15*b*.

Figure 20:
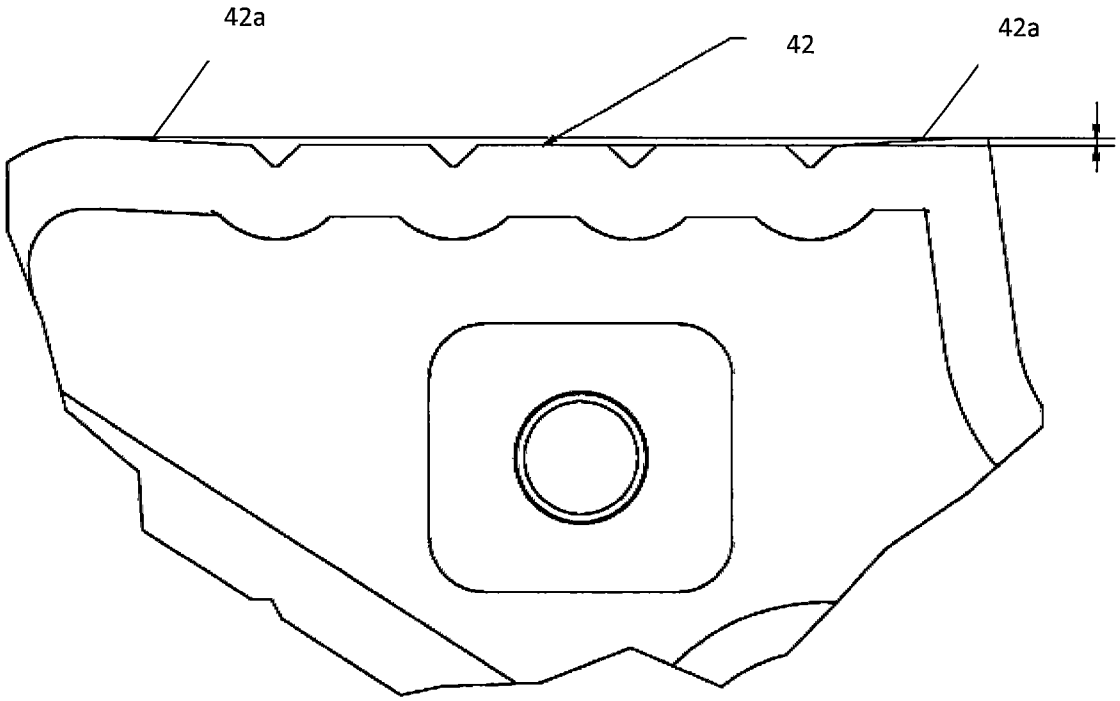
FIG. 20: shows a plan view of the spacer locating former shown in FIG. 19.

In one preferred aspect of the invention, the top of the spacer locating former 40 and the locating spacer 26 are not flat, as shown in FIG. 20. The top is preferably slightly concave, as indicated at 42, to form a concavity. The top of the spacer locator former is thus not planar. This ensures the locating spacers lie flat on the concrete stair mould (they only touch on the outside edges) and there is no concrete ingress on to the top of finished embedded nosing.

Similarly, in one embodiment of the invention, the inserts 15 are also slightly concave, to form a concavity. The top of the insert is thus also not planar. Being slightly concave adds friction and improving anti-slip properties to the stair edging component or nosing extrusion 23.

Figure 21:
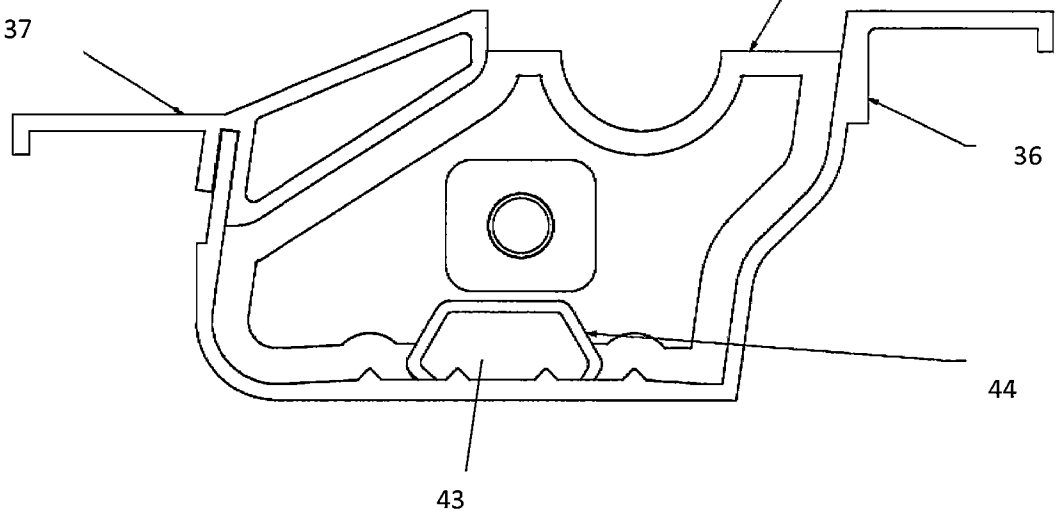
FIG. 21: shows a cross-sectional view of a mould assembly and insert according to a further aspect of the present invention.

In an alternative aspect of the present invention, inserts 15 may be provided with an additional component 43, as shown in FIG. 21. This additional component may be, for example, an LED light or other high visibility component, or an anti-slip component.

Figure 22:
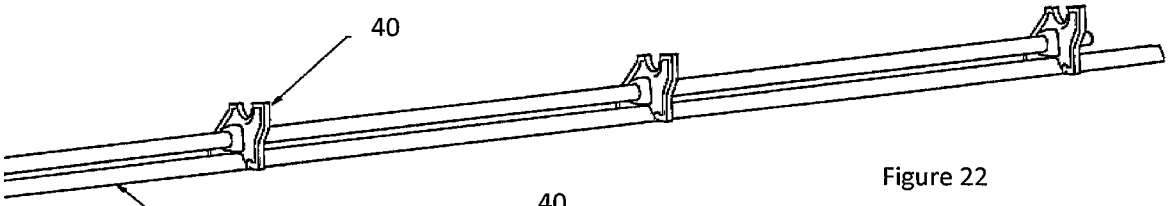
FIG. 22: shows a perspective view of a portion of the mould assembly shown in FIG. 21.

To provide for this additional component 43, the mould assembly 36 may be provided with an additional pipe or extrusion 44, as shown in FIG. 22.

The pipe or extrusion 44 may be made from PVC so that it may flex inwards for easy removal from the concrete once the insert 15 is made, or it could be left in the insert 15 to enable components to be clipped in.

In a preferred embodiment of the invention, the insert 15 of the present invention is made from concrete or an epoxy-concrete composite or the like. More preferably, the insert 15 is made from a strong or hard concrete or concrete composite (optionally, harder and stronger than the concrete forming the stair) so that wear on the edge of each step of a stair is reduced.

The insert and nosing assembly of the present invention provide a number of useful features. Variable length inserts allow a user to form a nosing assembly of a desired length for any particular stairs, so there is no need to make each nosing to suit a particular customer's requirements. Shorter inserts are also easy to transport to end use locations.

The nosing assembly of the present invention may be more likely to sit flat in the stair mould because the assembled nosing, with the tensioning wire, allows the assembly to bend and flex even though it is exposed to considerable pressure (for example, over 100 kg). Also, some stair moulds may not have flat surfaces and if the nosings are not lying flat on the mould surfaces there will be concrete ingress and the definition between the nosing and the stair faces will be uneven and unsightly.

The nosing assembly of the present invention does not need additional reinforcing, which can provide a cost advantage in some situations.

The spacer/locating system of the present invention provides for accurate formation of the nosing assemblies and stairs comprising such nosing assemblies. The manufacture system using sacrificial PVC pipes is accurate and flexible regarding the length of the insert and nosing assembly created.

The slightly concave shape of the top of the locating spacer and insert ensures the nosing assembly lies flat on the concrete stair mould (the nosing assembly only touches the stair mould on its outside edges as indicated at 42*a* in FIG. 20), which prevents any concrete ingress on to the top of finished embedded nosing. In one preferred form of the invention, the degree of concavity is about 3 mm.

The present invention and its embodiments have been described in detail. However, the scope of the present invention is not intended to be limited to the embodiment described in the specification. Modifications and variations may be made to the disclosed embodiment without departing from the scope or essential characteristics of the present invention.

The invention claimed is:

1. A stair edging component comprising:

a plurality of elongate inserts, each insert of said plurality of inserts comprising:

a main body having a tread surface and a coupling interface to couple the main body to the stair, and an opening extending through the length of the main body, wherein the coupling interface comprises at least one hooking part for securing the main body to a stair, a locating spacer located between pairs of adjacent inserts, and a tensioner extending through the opening in each insert of said plurality of inserts and extending along the length of the stair edging component; wherein the tensioner is secured by way of one or more crimping ferrules.

2. The stair edging component as claimed in claim 1, wherein each insert of said plurality of inserts comprises a locating recess at least one end thereof.

3. The stair edging component as claimed in claim 1, wherein each insert of said plurality of inserts comprises a locating recess at each end thereof.

4. The stair edging component as claimed in claim 1, wherein the coupling interface comprises at least one recess for engagement with a lip of the stair.

5. The stair edging component as claimed in claim 1, wherein the coupling interface comprises at least one clamping recess adapted to receive a positioning device during moulding of the stair.

6. The stair edging component as claimed in claim 1, wherein each locating spacer is provided with an opening therein, corresponding to the opening in each insert of said plurality of inserts.

7. The stair edging component as claimed in claim 1, wherein the profile of each insert of said plurality of inserts is substantially similar to the profile of each locating spacer.

8. The stair edging component as claimed in claim 1, wherein at least one surface of each locating spacer is not planar.

9. The stair edging component as claimed in claim 1, wherein the tread surface of each insert of said plurality of inserts is not planar.

10. The stair edging component as claimed in claim 1, wherein the tensioner is a wire or cable.

11. The stair edging component as claimed in claim 1, wherein each insert of said plurality of inserts being further provided with one or more locating pins.

12. The stair edging component as claimed in claim 1, wherein said at least one hooking part is shaped to extend into the stair when the stair edging component is incorporated in a step.

* * * * *